US009893474B1

(12) United States Patent
Jandt et al.

(10) Patent No.: US 9,893,474 B1
(45) Date of Patent: Feb. 13, 2018

(54) ACTIVE CABLE HEAT SINK

(71) Applicant: International Business Machines Corporation, Armonk, NY (US)

(72) Inventors: Tyler Jandt, Rochester, MN (US); Phillip V. Mann, Rochester, MN (US); Mark D. Plucinski, Toms River, NJ (US); Sandra Shirk/Heath, Rochester, MN (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 15/292,046

(22) Filed: Oct. 12, 2016

(51) Int. Cl.

| | |
|---|---|
| ***H01R 12/00*** | (2006.01) |
| ***H01R 13/66*** | (2006.01) |
| ***H01R 13/6592*** | (2011.01) |
| ***H01R 9/03*** | (2006.01) |

(52) U.S. Cl.
CPC ..... *H01R 13/665* (2013.01); *H01R 9/03* (2013.01); *H01R 13/6592* (2013.01)

(58) Field of Classification Search
CPC ..... H01R 13/665
USPC ..... 439/76.1
See application file for complete search history.

(56) References Cited

U.S. PATENT DOCUMENTS 6,278,610 B1 * 8/2001 Yasufuku ..... H05K 7/1431 165/185
6,585,534 B2 * 7/2003 Llapitan ..... H01L 23/4093 257/E23.086
6,726,497 B2 * 4/2004 Nogawa ..... H01R 12/88 439/260
7,133,285 B2 11/2006 Nishimura
7,355,857 B2 * 4/2008 Pirillis ..... H05K 7/20418 165/80.3
7,371,014 B2 * 5/2008 Willis ..... G02B 6/3887 385/24
7,529,094 B2 * 5/2009 Miller ..... G02B 6/4246 165/185
7,845,983 B2 * 12/2010 Kawada ..... H01Q 1/1271 439/607.46
7,922,518 B1 4/2011 Takehara et al.
7,974,098 B2 * 7/2011 Oki ..... G02B 6/4201 165/185
8,081,470 B2 * 12/2011 Oki ..... G02B 6/4201 165/185

(Continued)

FOREIGN PATENT DOCUMENTS

| | | |
|---|---|---|
| CN | 204809532 U | 11/2015 |
| WO | 2013126488 A1 | 8/2013 |
| WO | 2015049258 A1 | 4/2015 |

*Primary Examiner* — Tulsidas C Patel
*Assistant Examiner* — Peter G Leigh
(74) *Attorney, Agent, or Firm* — Patterson & Sheridan, LLP

(57) ABSTRACT

A cable, system, and method for cooling a semiconductor chip on an active cable. The active cable includes a heat sink that is thermally coupled to the semiconductor chip and movable from a retracted position to an extended position. The heat sink is in the retracted position when the active cable is not installed in a card connector in a computer case. After the active cable is installed in the card connector, the heat sink is urged to the extended position in which the heat sink is exposed to air flow circulation within the computer case.

19 Claims, 11 Drawing Sheets

(56) References Cited

U.S. PATENT DOCUMENTS

| | | | | |
|---|---|---|---|---|
| 8,475,195 | B2 * | 7/2013 | Annis | H01R 12/7029 439/160 |
| 8,529,282 | B1 * | 9/2013 | Westman | H01R 12/737 439/345 |
| 8,853,727 | B1 | 10/2014 | Sanso et al. | |
| 8,911,244 | B2 * | 12/2014 | Elison | H05K 7/20454 439/137 |
| 9,210,812 | B2 * | 12/2015 | Regnier | H01R 13/6658 |
| 9,391,407 | B1 * | 7/2016 | Bucher | H01R 13/659 |
| 9,407,046 | B1 * | 8/2016 | Bucher | G02B 6/00 |
| 9,419,380 | B2 * | 8/2016 | Sharf | H01R 12/724 |
| 9,509,102 | B2 * | 11/2016 | Sharf | H01R 13/665 |
| 9,603,286 | B2 * | 3/2017 | Carpenter | H05K 9/0032 |
| 2010/0029104 | A1 * | 2/2010 | Patel | H01R 13/6658 439/76.1 |
| 2012/0206248 | A1 * | 8/2012 | Biggs | G06F 3/016 340/407.2 |
| 2013/0157499 | A1 * | 6/2013 | Crippen | H01R 12/724 439/487 |
| 2014/0328563 | A1 * | 11/2014 | Demeritt | G02B 6/4436 385/100 |
| 2015/0280368 | A1 * | 10/2015 | Bucher | H01R 13/665 439/487 |
| 2016/0064873 | A1 * | 3/2016 | Bucher | H01R 12/7076 385/88 |
| 2016/0149324 | A1 * | 5/2016 | Regnier | H01R 12/721 439/76.1 |
| 2016/0211625 | A1 * | 7/2016 | Sharf | H01R 12/721 |
| 2016/0295744 | A1 * | 10/2016 | Regnier | G02B 6/4269 |
| 2017/0094830 | A1 * | 3/2017 | Bucher | H05K 1/0203 |

* cited by examiner 300
302
304
306
308
310
312
314
320
324
326
326'
340
360
362
362'
364
250
102
A
B
C 600
602
608
102
610
620
622
624
626
626'
640
250
364
D
A
B
C 700
702
102
708
706
720
722
722'
724
726
726'
730
730'
732
740
250
364
A
B
C
D

ACTIVE CABLE HEAT SINK

BACKGROUND

Active cables include semiconductor chips that modify and/or boost the performance of data signals transmitted along the cable. For example, a semiconductor chip, which may be arranged in a cable connector housing of an active cable, may perform equalization and/or de-skew operations on data signals carried by the active cable. Such semiconductor chips generate heat as they operate, which may require the use of a heatsink. However, the geometry of the cable connector and a computer connector (e.g., a card connector) can make it difficult to properly couple a heatsink in close proximity to the semiconductor chip.

SUMMARY

According to one embodiment, an electrical cable comprises a cable comprising multiple signal conductors. The electrical cable also comprises a cable connector housing that includes a distal end, configured for engagement with a card connector housing, and an opposing proximal end. The electrical cable also comprises a paddle card arranged within the cable connector housing. The paddle card includes a first plurality of contacts arranged along an edge of the paddle card facing the distal end of the cable connector housing. The first plurality of contacts are configured to engage card connector contacts of the card connector. The paddle card also includes a second plurality of contacts arranged along an edge of the paddle card toward the proximal end of the cable connector housing. The second plurality of contacts are connected to respective ones of the multiple signal conductors. The paddle card also includes a semiconductor chip arranged on the paddle card and in electrical communication with the first plurality of contacts and the second plurality of contacts. The semiconductor chip is operable to modify electrical signals between the first and second plurality of contacts. The electrical cable also comprises a heat sink thermally coupled to the semiconductor chip. The heat sink is movable from a retracted position to an extended position when the cable connector is seated in the card connector. The heat exchanger is positioned within the cable connector housing in the retracted position. At least a portion of the heat exchanger extends through the cable connector housing and the card connector in the extended position.

According to one embodiment, a system comprises a computer card. The computer card comprises a data processing card. The computer card also includes a card connector housing that includes a first end and an opposing second end. The card connector housing includes a window arranged at a location between the first and second ends. The card connector housing includes a plurality of card contacts arranged toward the first end and an opening at a second opposing end. The plurality of card contacts are operatively connected to the data processing card. The system also includes an electrical cable. The electrical cable comprises a cable comprising multiple signal conductors. The electrical cable also comprises a cable connector housing that includes a distal end configured for engagement with the card connector housing and an opposing proximal end. The electrical cable also comprises a paddle card arranged within the cable connector housing. The paddle card comprises a first plurality of contacts arranged along an edge of the paddle card facing the distal end of the cable connector housing. The first plurality of contacts are configured to engage the plurality of card contacts of the card connector. The paddle card also comprises a second plurality of contacts arranged along an edge of the paddle card toward the proximal end of the cable connector housing. The second plurality of contacts are connected to respective ones of the multiple signal conductors. The paddle card also includes a semiconductor chip arranged on the paddle card and in electrical communication with the first plurality of contacts and the second plurality of contacts. The semiconductor chip is operable to modify electrical signals between the first and second plurality of contacts. The electrical cable also comprises a heat sink thermally coupled to the semiconductor chip. The heat sink is movable from a retracted position to an extended position when the cable connector is seated in the card connector. The heat exchanger is positioned within the cable connector housing in the retracted position. At least a portion of the heat exchanger extends through the cable connector housing and the window in the card connector housing in the extended position.

According to one embodiment, a method of connecting an active cable comprises inserting an active cable connector housing into a card connector housing. Contacts of the cable connector housing engage contacts of the card connector housing after the active cable connector housing is inserted into the card connector housing. A heat exchanger, thermally coupled to an integrated circuit in the active connector housing, extends through a window in the card connector housing when the contacts of the cable connector housing and card connector housing are engaged.

DETAILED DESCRIPTION

In the following, reference is made to embodiments presented in this disclosure. However, the scope of the present disclosure is not limited to specific described embodiments. Instead, any combination of the following features and elements, whether related to different embodiments or not, is contemplated to implement and practice contemplated embodiments. Furthermore, although embodiments disclosed herein may achieve advantages over other possible solutions or over the prior art, whether or not a particular advantage is achieved by a given embodiment is not limiting of the scope of the present disclosure. Thus, the following aspects, features, embodiments and advantages are merely illustrative and are not considered elements or limitations of the appended claims except where explicitly recited in a claim(s). Likewise, reference to "the invention" or "the disclosure" shall not be construed as a generalization of any inventive subject matter disclosed herein and shall not be considered to be an element or limitation of the appended claims except where explicitly recited in a claim(s).

Data processing cards (e.g., graphics processing cards and network cards) typically include card connectors that enable connection to other devices (e.g., computer displays and network switches) via cables. In some instances, the card connectors are configured to receive active cables, and the active cables provide on-board data processing to signals carried thereon. As discussed above, such active cables include semiconductor chips that perform the data processing, and such semiconductor chips may require cooling via a heatsink.

In embodiments described herein, an active cable includes a semiconductor chip in a cable connector housing of the active cable and a movable heatsink that is thermally coupled to the semiconductor chip. The heatsink is movable from a retracted position to an extended position after the cable connector housing of the active cable is inserted into a card connector housing in a computer case. When the heatsink is in the extended position, the heatsink is exposed to a free airflow in the computer case, which provides adequate cooling for the semiconductor chip.

Figure 1A:
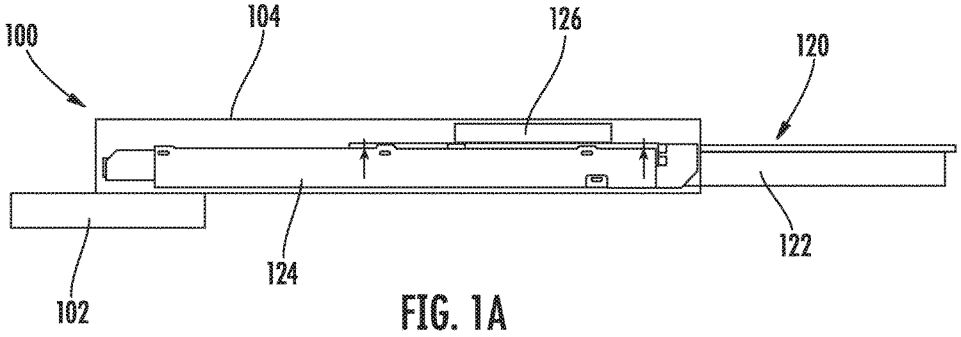
FIG. 1A is a cross-sectional side view of a cable connector housing, according to one embodiment, inserted into a card connector housing, wherein a heatsink is in a retracted position.
Figure 1B:
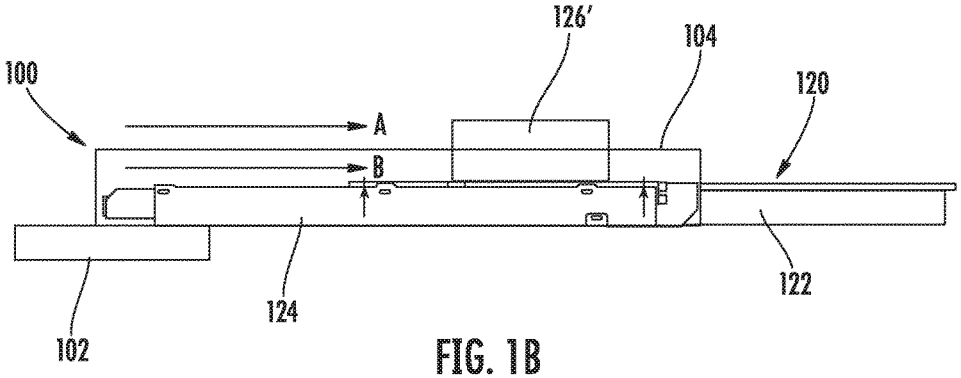
FIG. 1B is a cross-sectional side view of the cable connector housing and card connector housing of FIG. 1A, wherein the heatsink is in an extended position.

FIGS. 1A and 1B illustrate a cable connector 120 engaged with a card connector 100. A cable connector housing 124 of the cable connector 100 is inserted into a card connector housing 104 of the card connector 100 with a heatsink 126 in a retracted position (in FIG. 1A) and an extended position (126') (in FIG. 1B). As shown in FIG. 1B, the extended heatsink 126' is exposed to a freestream airflow (indicated by arrow A) in a computer chassis or other enclosure in which the card connector 100 is arranged. For example, a computer chassis typically includes one or more cooling fans that circulate air in the chassis for cooling various components within the chassis. The circulating air is a freestream airflow that can cool the extended heatsink 126'. At least some of the circulating air may pass through the cable connector housing 124 and card connector housing 104, providing additional cooling to a portion of the extended heat sink 126' that does not extend out of the card connector housing 104.

Figure 1C:
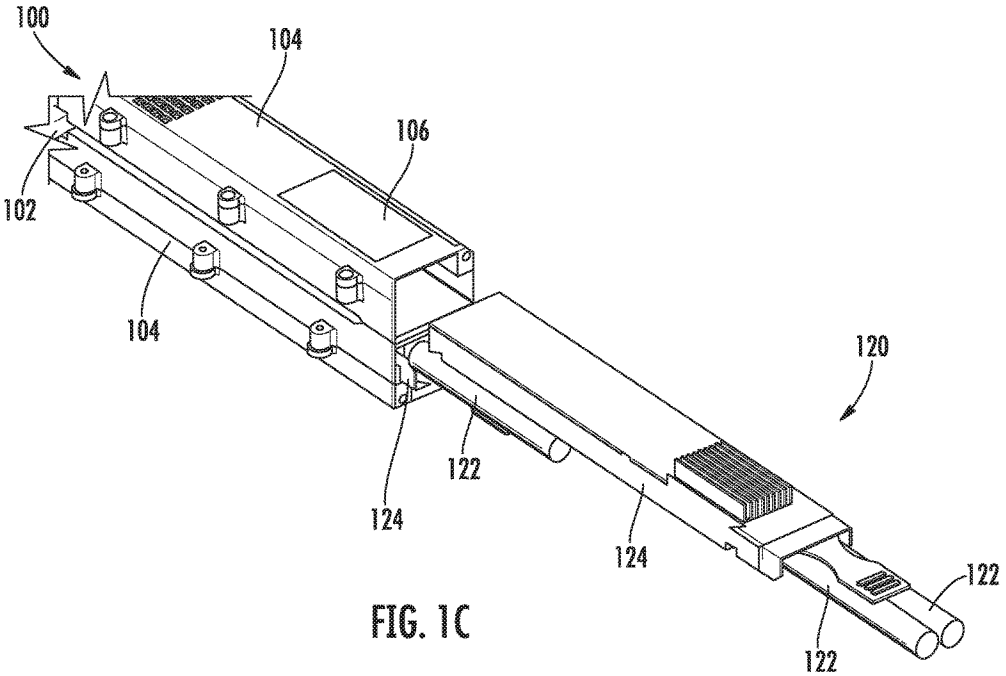
FIG. 1C is a perspective view of two card connector housings arranged in a belly-to-belly configuration on a card, with a first cable connector housing inserted into one of the card connector housings and a second cable connector housing aligned for insertion into the remaining card connector housing.

FIG. 1C is a perspective view of a card connector 100 that includes two card connector housings 104 connected to a data processing card 102, wherein the two card connector housings are arranged in a belly-to-belly configuration. A bottom card connector housing 104 has a cable connector housing 124 inserted therein, and a top cable connector housing 124 is aligned for insertion into a top card connector housing 104. The perspective view in FIG. 1C illustrates a window 106 or opening in the card connector housing 104 through which the heatsink 126 of the cable connector 120 can extend after the cable connector housing 124 is inserted into the card connector housing 104.

Figure 2:
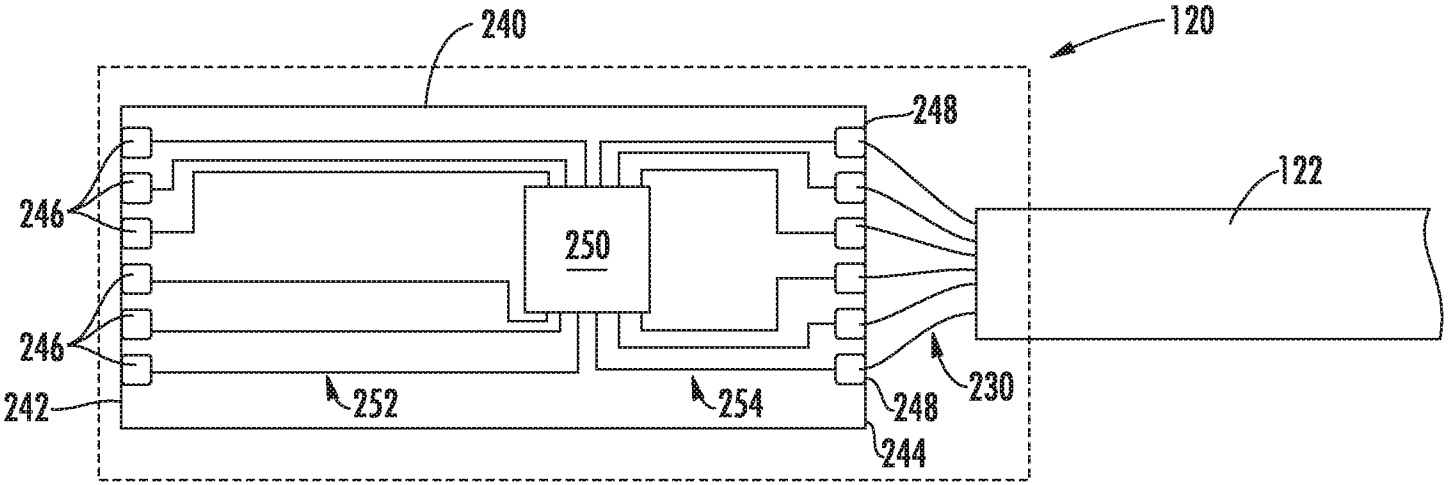
FIG. 2 is a top view of a paddle card of a smart cable with a semiconductor chip arranged on the paddle card and in communication with contacts on the paddle card.

FIG. 2 is a plan view of an exemplary circuit in the cable connector 120 for an active cable, wherein the cable connector housing 124 is illustrated in broken line. The cable connector 120 includes an outer jacket 122 (e.g., an insulation jacket) for the cable extending into the cable connector housing 124 and a plurality of wires 230 extending from the jacket 122. The cable connector 120 also includes a paddle card 240, which may be a printed circuit board or the like. In at least one embodiment, the paddle card 240 is sufficiently thin such that the printed circuit board 240 is flexible. In other embodiments, the paddle card 240 is rigid. The printed circuit board 240 includes a distal edge 242 and an opposing proximal edge 244, wherein distal and proximal are with respect to the plurality of wires 230. The paddle card 240 includes a first plurality of contacts 246 arranged along the distal edge 242 and a second plurality of contacts 248 arranged along the proximal edge 244. The exemplary paddle card 240 includes six contacts along the distal edge 242 and the proximal edge 244. In other embodiments, the paddle card 240 could include more or fewer contacts. The paddle card 240 includes a semiconductor chip 250 arranged thereon. The contacts 246 and 248 are connected to the semiconductor chip 250 by respective conductive traces 252 and 254. The wires 230 are connected to the second plurality of contacts 248 via solder, brazing, or other electrical connection. In at least one embodiment, the wires 230 have sufficient extra length to allow for movement of the paddle card 240 relative to the cable connector housing 124. As discussed above, signals traveling through the wires 230 in the cable are transmitted to the semiconductor chip 250 via the second plurality of contacts 248 and electrical traces 254. The semiconductor chip 250 performs signal processing on the signals from the wires 230 and transmits the processed signals to the first plurality of contacts 246 via the electrical traces 252. As discussed above, the semiconductor chip 250 generates heat as it operates to process the signals.

Figures 3A, 3B, 3C:
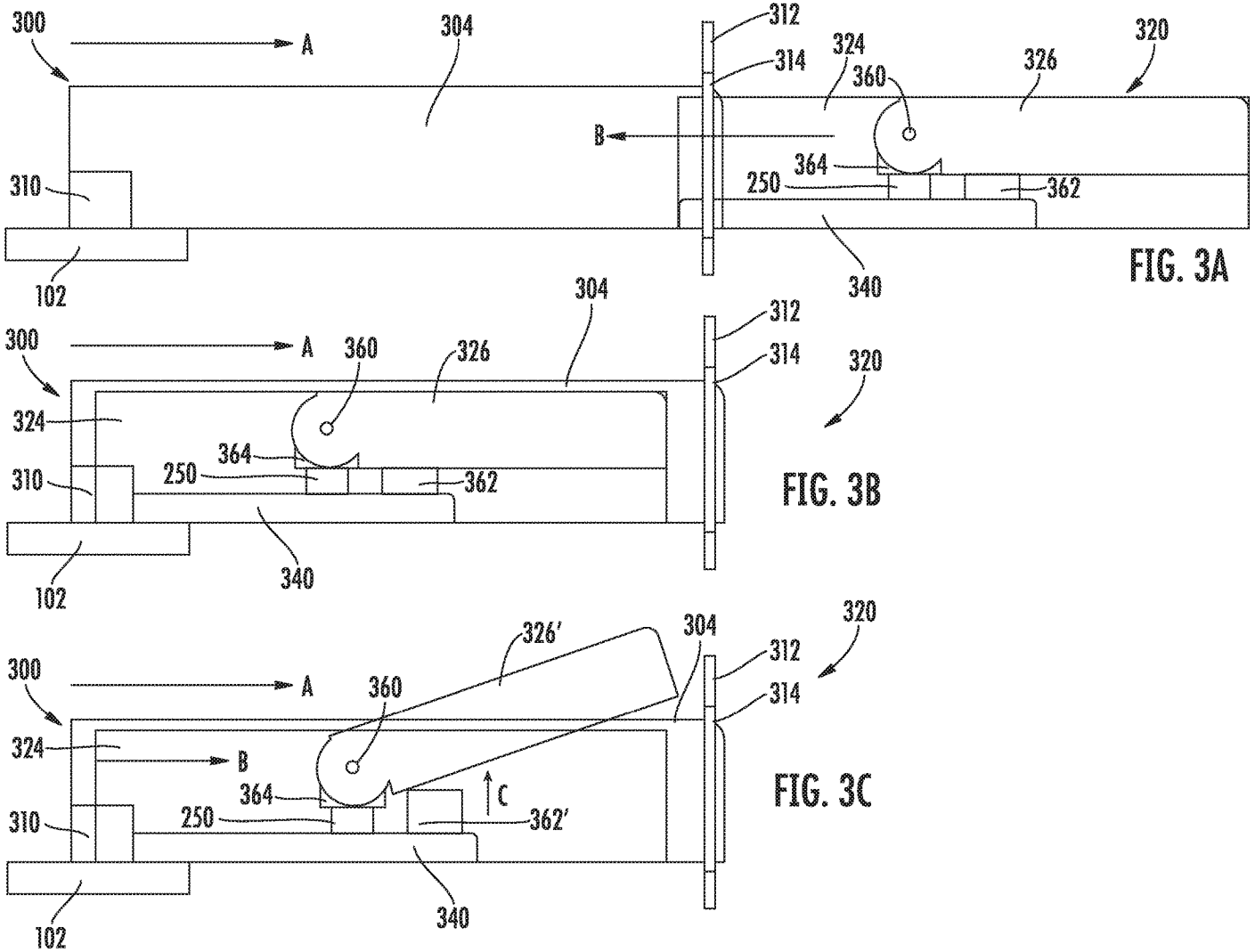
FIG. 3A is a cross-sectional side view of a cable connector housing and a card connector housing, according to one embodiment, in which the cable connector housing is aligned for insertion into the card connector housing.
FIG. 3B is a cross-sectional side view of the cable connector housing and card connector housing of FIG. 3A in which the cable connector housing is fully inserted into the card connector housing, and wherein a heatsink is in a retracted position.
FIG. 3C is a cross-sectional side view of the cable connector housing card connector housing of FIG. 3A in which the cable connector housing is fully inserted into the card connector housing, and wherein the heatsink has rotated to an extended position.

FIGS. 3A-3C illustrate an embodiment of a card connector 300 and a cable connector 320 with an extendable heatsink 326. The card connector 300 includes a card connector housing 304 that is coupled to a data processing card 102 such that card contacts in a contact housing 310 are in electrical communication with circuit elements on the data processing card 102. The card connector housing 304 may include a tailstock 312 connects to a computer chassis or case and that supports the card connector housing 304. The tailstock 312 includes an opening 314 through which the card connector housing 304 can be accessed.

The cable connector 320 includes a cable connector housing 324 and a paddle card 340 (e.g., the same as paddle card 240 illustrated in FIG. 2) arranged along a surface of the cable connector housing 324. The semiconductor chip 250 is mounted on a substantially planar surface of the paddle card 340. The heatsink 326 is connected to the cable connector 324 via a hinge 360. The hinge 360 may be a cylindrical shaft extending between opposing walls of the cable connector housing 324 that supports the heatsink 326 such that the heatsink can rotate about the shaft. The heatsink 326 is thermally coupled to the semiconductor chip 250. In one embodiment, the heatsink 326 directly contacts the semiconductor chip 250. In at least one other embodiment, a thermal interface 364 (e.g., a thermal paste) is arranged between the semiconductor chip 250 and the heatsink 326 to promote heat transfer from the semiconductor chip 250 to the heatsink 326.

In the embodiment illustrated in FIGS. 3A-3C, the paddle card 340 also includes an electroactive polymer (EAP) material 362 arranged on the same surface as the semiconductor chip 250 and in electrical communication with one of the conductive traces 252, 254 and/or with one of the contacts 246, 248 of the paddle card 240. The EAP material 262 expands in a particular direction when an electrical voltage is applied. FIG. 3B illustrates the cable connector housing 324 inserted through the opening 314 in the tailstock 312 and into the card connector housing 304 such that the distal end of the paddle card 340 makes contact with a card contact housing 310 that contains card contacts. The card contacts in the card contact housing 310 are electrically connected to circuit elements of the data processing card 102. The card contacts in the card contact housing 310 are arranged to contact respective ones of the first plurality of contacts 246 on the paddle card 340 when the paddle card 340 engages the card contact housing 310 (as the cable connector housing 324 is inserted into the card connector housing 304 in the direction of arrow D). When the first plurality of contacts 246 are connected to the card contacts and the card contacts are electrically powered (e.g., the computer in which the card connector 300 is installed is turned on), the EAP material 362 receives a voltage and expands in a direction away from the paddle card 340, as indicated by arrow C and reference numeral 326' in FIG. 3C. The expansion of the EAP material 362' urges the heat shield 326 to rotate about the hinge 360 to the extended position (indicated by reference numeral 326') shown in FIG. 3C.

Figure 3D:
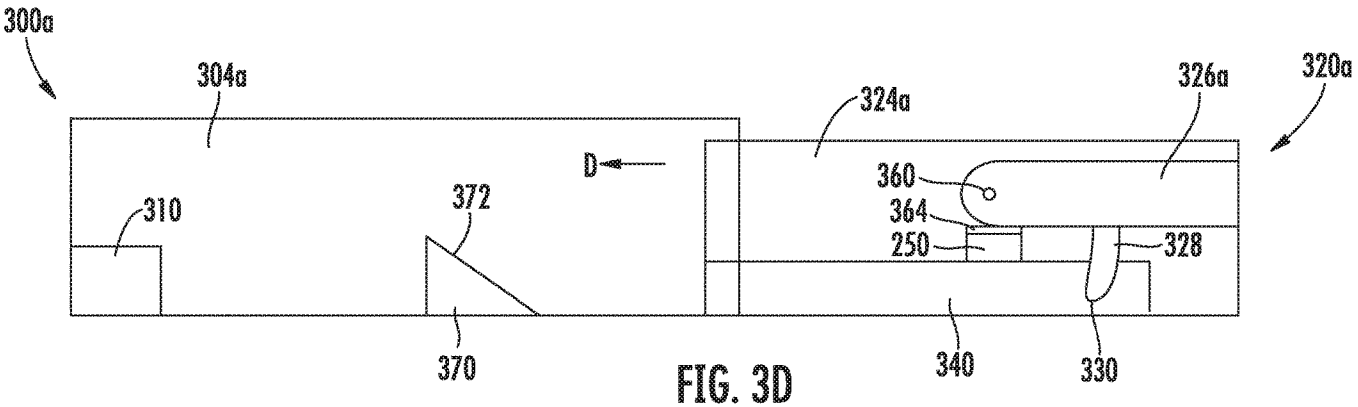
FIG. 3D is a cross-sectional side view of a cable connector housing and a card connector housing, according to one embodiment, in which the cable connector housing is aligned for insertion into the card connector housing.
Figure 3E:
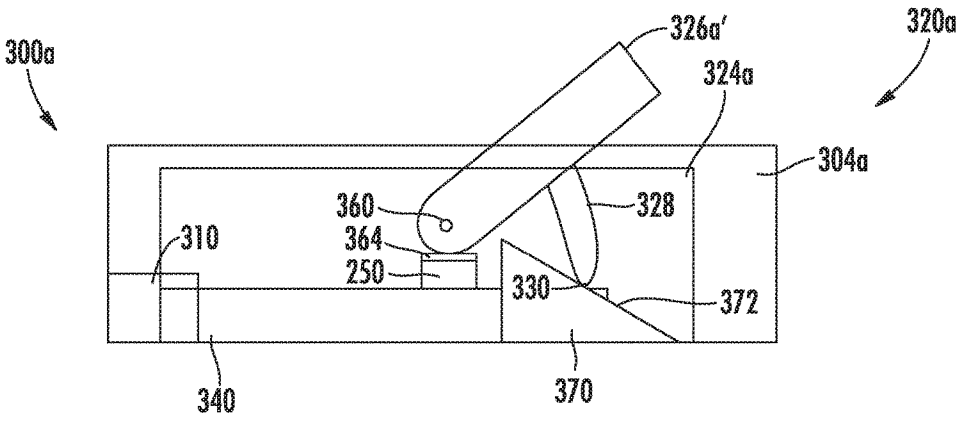
FIG. 3E is a cross-sectional side view of the cable connector housing card connector housing of FIG. 3D in which the cable connector housing is fully inserted into the card connector housing, and wherein the heatsink has rotated to an extended position.

FIGS. 3D and 3E illustrate another embodiment of the cable connector housing 324*a* and card connector housing 304*a* in which the heatsink 326*a* is urged to pivot about the hinge 360 by a protrusion 328 extending from the heatsink 326*a*. The protrusion 328 includes a tip 330 extending toward the paddle card that engages a ramp 370 in the card connector housing 304*a*. The ramp 370 in the card connector housing 304*a* includes an inclined surface 372. The ramp 370 and protrusion 328 could be arranged toward one side of the card connector housing 304*a* such that the ramp 370 and protrusion 328 are alongside the paddle card 340. In at least one embodiment, the tip 330 includes a rounded surface. As shown in FIG. 3E, when the cable connector housing 324*a* is inserted into the card connector housing 304*a*, the tip 330 of the protrusion 328 engages the inclined surface 372 of the ramp 370, which causes the protrusion 328 to be displaced. As a result, the heatsink 326*a* is urged to the extended position (indicated by reference numeral 326*a*').

Figure 3F:
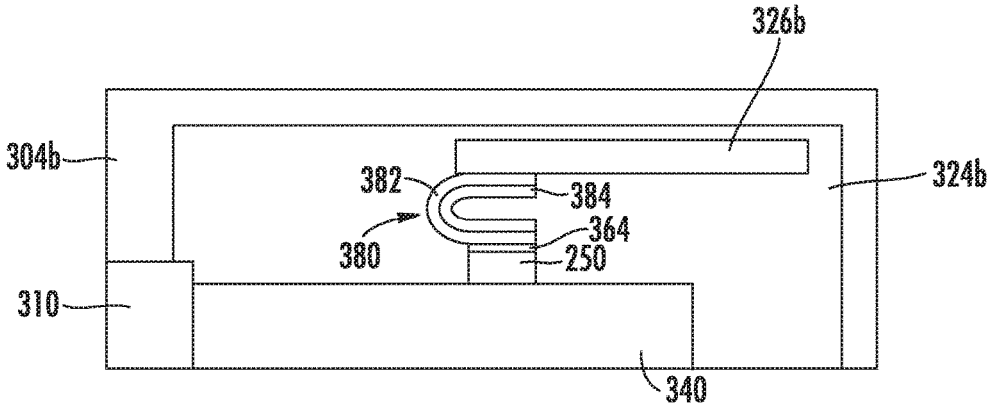
FIG. 3F is a cross-sectional side view of a cable connector housing and a card connector housing, according to one embodiment, in which the cable connector housing is fully inserted into the card connector housing.
Figure 3G:
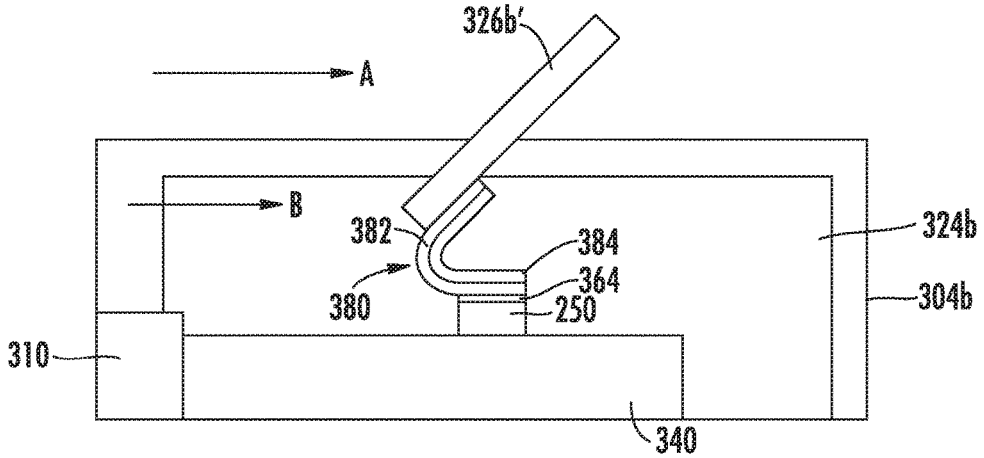
FIG. 3G is a cross-sectional side view of the cable connector housing card connector housing of FIG. 3F in which the cable connector housing is fully inserted into the card connector housing, and wherein the heatsink has rotated to an extended position.

FIGS. 3F and 3G illustrate another embodiment of the cable connector 324*b* and card connector 304*b* in which the heatsink 326*b* is connected to the semiconductor chip 250 (and, optionally, the thermal paste 364) via a hinge 380 that includes a laminate of two metals having to similar coefficients of thermal expansion. As shown in FIG. 3F, the hinge 380 is bent in a "U" shape, wherein a first side of the "U" is arranged on the semiconductor chip 250 (and, optionally, the thermal paste 364) and the second side of the "U" is attached to the heatsink 326*b*. The hinge 380 includes an outer layer 382 made of a first metal and an interior layer 384 made of a second metal. The second metal has a higher coefficient of thermal expansion than the first metal, meaning the second metal expands more than the first metal for a given temperature change.

Referring to FIG. 3G, when the active cable of the cable connector housing 324*b* is operating in the semiconductor chip 250 increases in temperature, heat from the semiconductor chip 250 is transferred to the heatsink 326*b* via the hinge 380 such that the hinge 380 also increases in temperature. As the hinge 380 increases in temperature, the second metal of the interior layer 384 of the hinge 380 expands more than the first metal of the outer layer 382. As a result, the hinge 380 opens and displaces the heatsink 326*b* to the extended position (indicated by reference numeral 326*b*').

Figure 4A:
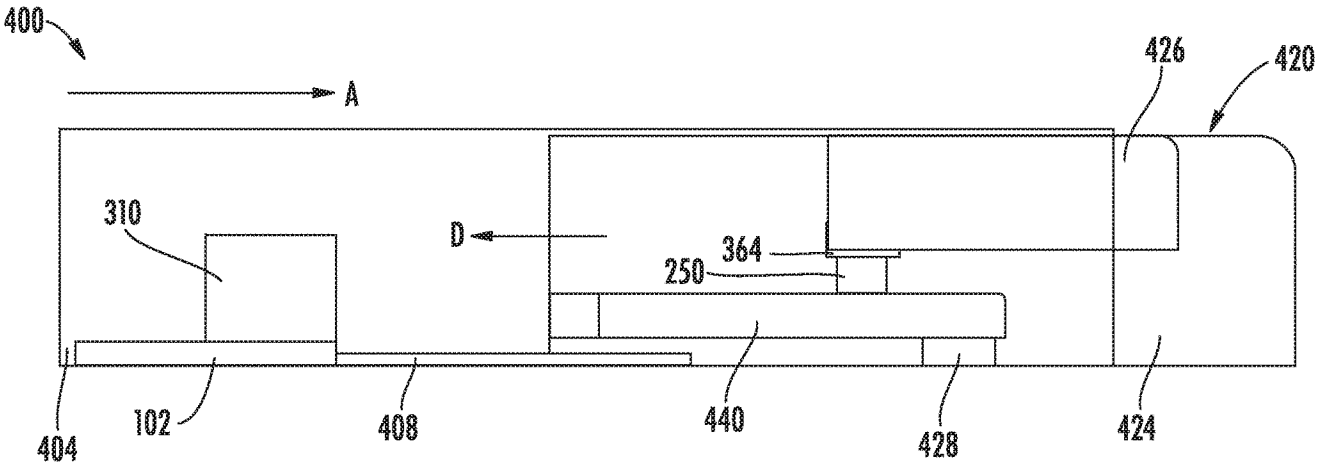
FIG. 4A is a cross-sectional side view of a cable connector housing and a card connector housing, according to one embodiment, in which the cable connector housing is partially inserted into the card connector housing.
Figure 4B:
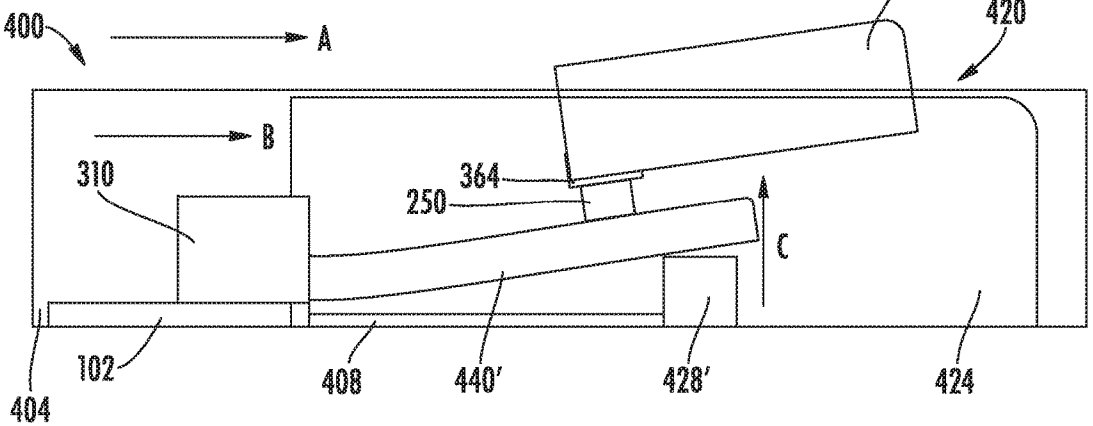
FIG. 4B is a cross-sectional side view of the cable connector housing and card connector housing of FIG. 4A, wherein the cable connector housing is fully inserted into the card connector housing, and wherein a paddle card of the cable connector housing is flexed such that a heat sink is moved to an extended position.

FIGS. 4A and 4B illustrate another embodiment of a cable connector 420 that uses a flexible paddle card 440 instead of a hinge to move a heatsink 426 to an extended position (indicated by reference numeral 426'), shown in FIG. 4B. The flexible paddle card 440 is urged from the position shown in FIG. 4A to the position shown in FIG. 4B by EAP material 428 arranged between a cable connector housing 424 and the paddle card 440. The card connector housing 404 includes the card contact housing 310 mounted on a data processing card 102 and also includes an electrical contact 408 extending toward the cable connector housing 424 along at least a portion of the card connector housing 404. When the cable connector housing 424 is inserted into the card connector housing 404 (in the direction of arrow D), the electrical contact 408 extending toward the cable connector housing 424 makes electrical contact with the EAP material 428. When the electrical contact 408 receives power (e.g., when the computer system in which the card connector 400 is installed is powered), the EAP material 428 expands in the direction of arrow C (indicated by reference numeral 428'), urging the paddle card 440 to flex or bend as shown in FIG. 4B (indicated by reference numeral 440') and causing the heatsink 426 to move to the extended position (indicated by reference numeral 426').

In FIGS. 4A and 4B, the heatsink 426 is illustrated as having one end arranged on the semiconductor chip 250 such that most of the heatsink 426 is exposed to the free stream airflow, indicated by arrow A in FIG. 4B. As discussed above, some airflow passes through the card connector housing 404 and the cable connector housing 424 such that portions of the heatsink 426 that do not extend out of the housings 404 and 424 also receives airflow (indicated by arrow B). In various embodiments, the heatsink 426 may be arranged on the semiconductor chip 250 in a different manner, based on the configuration of the heatsink, temperature considerations, airflow considerations, and other considerations. For example, in one embodiment, the heatsink 426 could be centered on the semiconductor chip 250.

Figure 5A:
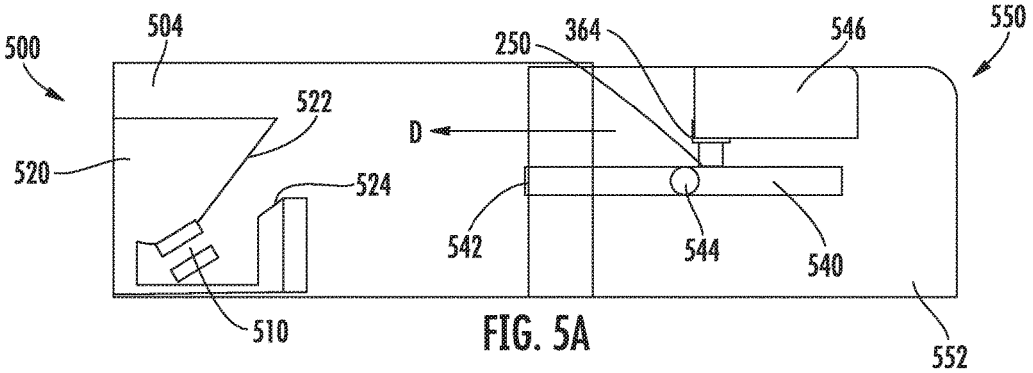
FIG. 5A is a cross-sectional side view of a cable connector housing and a card connector housing, according to one embodiment, in which the cable connector housing is partially inserted into the card connector housing.
Figure 5B:
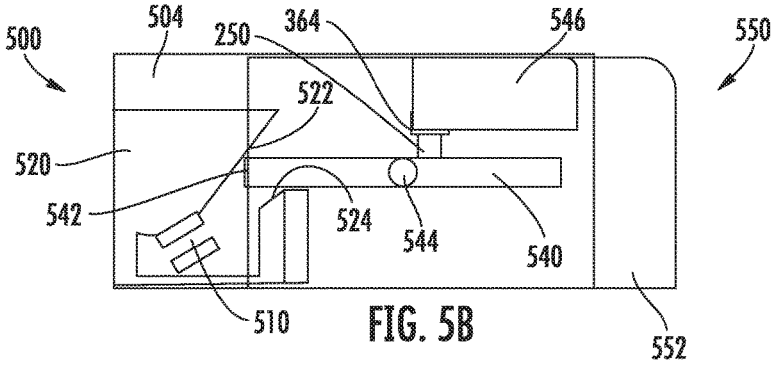
FIG. 5B is a cross-sectional side view of the cable connector housing and card connector housing of FIG. 5A, in which the cable connector housing is further inserted into the card connector housing such that a paddle card contacts a card contact housing.
Figure 5C:
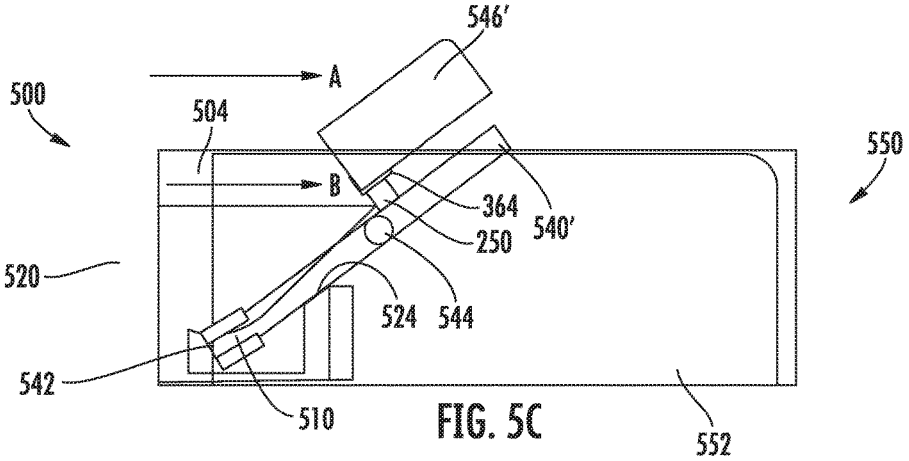
FIG. 5C is a cross-sectional side view of the cable connector housing and card connector housing of FIG. 5A, in which the cable connector housing is further inserted into the card connector housing such that the paddle card is rotated into alignment with the card contact housing and a heat sink attached to the paddle card is rotated to an extended position.

FIGS. 5A-5C illustrate another embodiment of a card connector 500 and cable connector 550 in which the paddle card 540 (e.g., the same as paddle card 240 illustrated in FIG. 2) is connected to a cable connector housing 552 via a hinge 544 such that the paddle card 540 pivots within the cable connector housing 552. When the paddle card 540 pivots from the position shown in FIGS. 5A and 5B to the position shown in FIG. 5C, the heatsink 546 moves from a retracted position to an extended position (indicated by reference numeral 546'). The card connector 500 includes a card connector housing 504 with a card contact housing 520 arranged therein. The card contact housing 520 includes angled surfaces 522 and 524 that define a channel leading to card connector contacts 510 within the card contact housing 520. As shown in FIGS. 5B and 5C, the leading edge 542 of the paddle card 540 contacts the angled surface 522 of the card contact housing 520, which urges the leading edge 542 of the paddle card 540 to tilt toward the card connector contacts 510. A bottom surface of the paddle card 540, opposite the surface on which the semiconductor chip 250 is arranged, contact the second angled surface 524, which provides alignment and engagement between the tilted paddle card 540' and the card connector contacts 510. As shown in FIG. 5C, tilting of the paddle card 540' moves the heat sink 546 to an extended position (indicated by reference numeral 546').

Figures 6A, 6B, 6C:
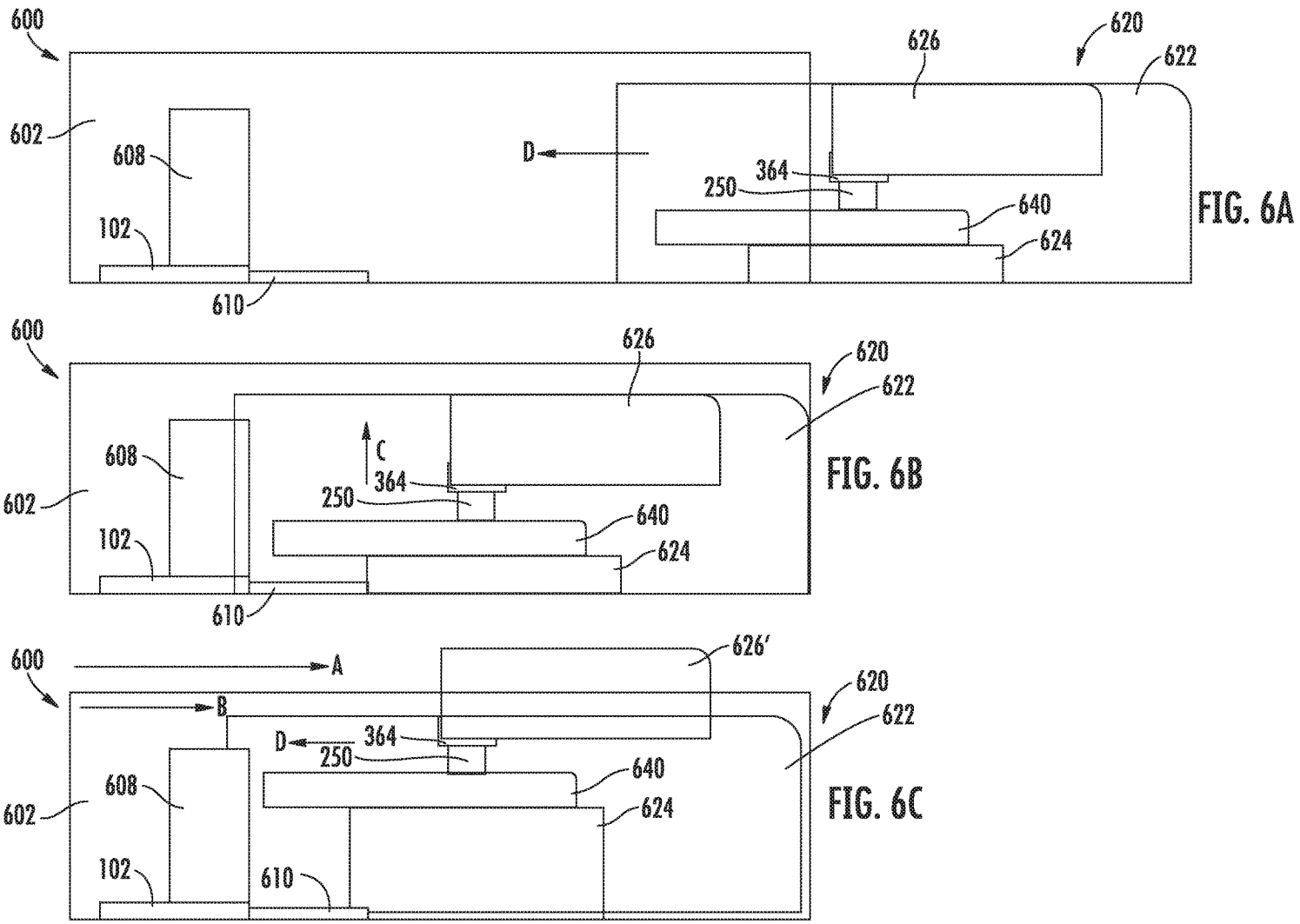
FIG. 6A is a cross-sectional side view of a cable connector housing and a card connector housing, according to one embodiment, in which the cable connector housing is partially inserted into the card connector housing.
FIG. 6B is a cross-sectional side view of the cable connector housing and card connector housing of FIG. 6A in which the cable connector housing is further inserted into the card connector housing such that an EAP material contacts an electrical contact.
FIG. 6C is a cross-sectional side view of the cable connector housing and card connector housing of FIG. 6A in which the EAP material is expanded to align a paddle card with a card contact housing.

FIGS. 6A-6C illustrate another embodiment of a card connector 600 and cable connector 620 in which the paddle card 640 is moved into alignment with a card contact 608 by EAP material 624. The card connector 600 includes a card connector housing 602 and a contact housing 608. The contact housing 608 is in electrical communication with the data processing card 102. The data processing card 102 includes an electrode 610 or other electrically conductive trace extending toward the cable connector 620. The cable connector 620 includes a cable connector housing 622 with an EAP material 624 arranged below a paddle card 640. The semiconductor chip 250 and heatsink 626 are arranged on top of the paddle card 640. As shown in FIG. 6A, the EAP material 624 is in an unexpanded state, and the heatsink 626 is in a retracted position within the cable connector housing 622. FIG. 6B illustrates the cable connector housing 622 inserted most of the way into the card connector housing 602 such that the electrode 610 contacts the EAP material 624. If the electrode 610 is receiving power when the electrode, then the EAP material 624 expands, thereby moving the paddle card 640, the semiconductor chip 250, and the heatsink 626. As shown in FIG. 6 C, the heatsink 626 is moved to an extended position (indicated by reference numeral 626') such that the heatsink 626 is exposed to the airflow indicated by arrow A. After the EAP material 624 has expanded, the paddle card 640 is aligned with the card contact 608, and the cable connector housing 622 can be further inserted into the card connector housing 602 to connect the first plurality of contacts 146 on the paddle card 640 to the card contacts 608. In various embodiments, the EAP material 624 expands nearly instantaneously such that the EAP material 624 would fully expand before the paddle card 640 makes contact with the card contacts 608 (within a normal range of speeds with which a user may insert the cable connector housing 622 and the card connector housing 602). In other embodiments, the EAP material 624 may require a short period of time to fully expand, and the user inserting the cable connector housing 622 into the card connector housing 602 may have to pause briefly before completely inserting the cable connector housing 622 into the card connector housing 602.

Figures 7A, 7B, 7C, 7D:
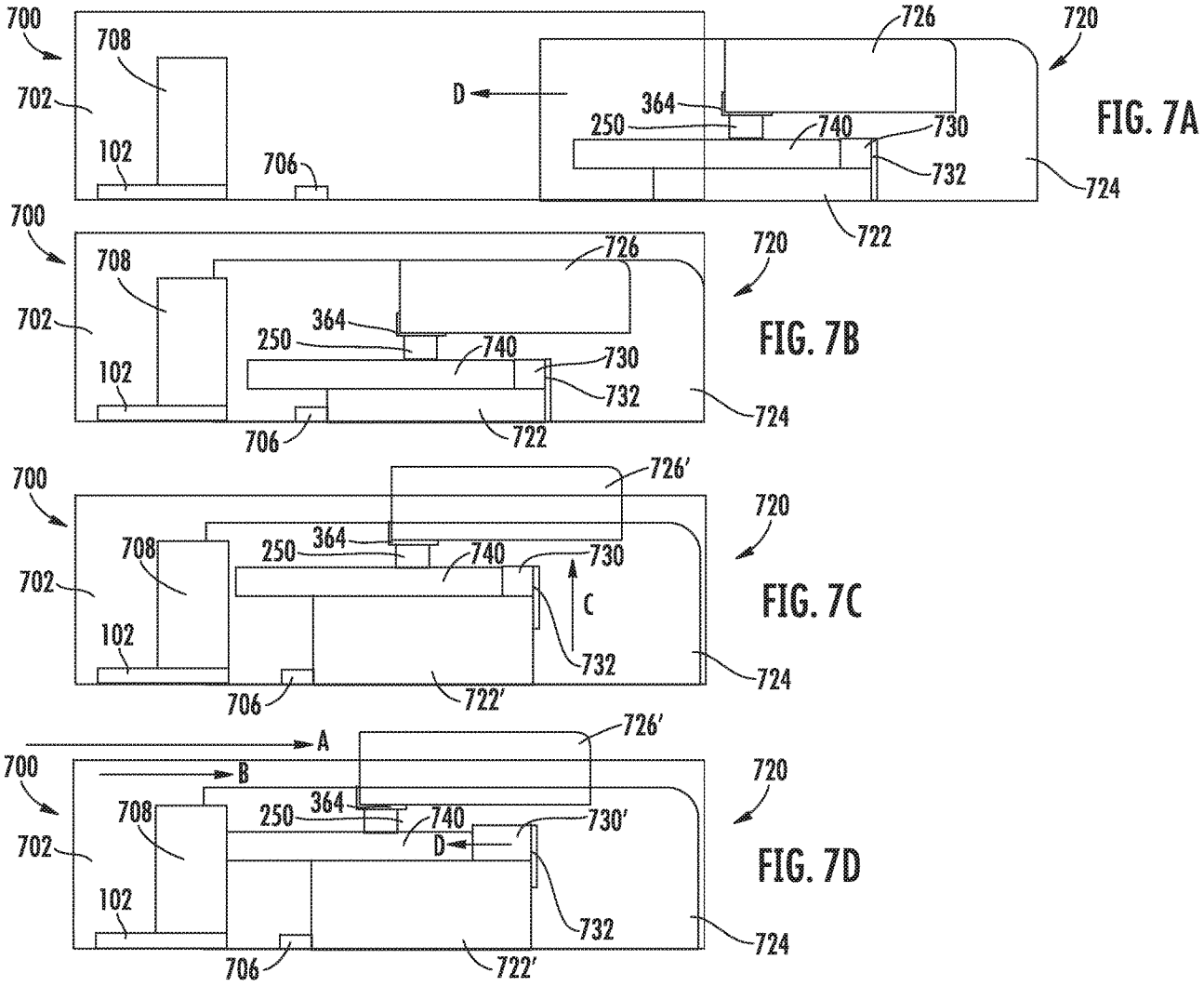
FIG. 7A is a cross-sectional side view of a cable connector housing and a card connector housing, according to one embodiment, in which the cable connector housing is partially inserted into the card connector housing.
FIG. 7B is a cross-sectional side view of the cable connector housing and card connector housing of FIG. 7A in which the cable connector housing is further inserted into the card connector housing such that a first EAP material contacts an electrical contact.
FIG. 7C is a cross-sectional side view of the cable connector housing and card connector housing of FIG. 7A in which the first EAP material is expanded to align a paddle card with a card contact housing.
FIG. 7D is a cross-sectional side view of the cable connector housing and card connector housing of FIG. 7A in which a second EAP material is expanded to push the paddle card into contact with the card contact housing.

FIGS. 7A-7D illustrate another embodiment of a card connector 700 and cable connector 720 in which a cable connector housing 724 of the cable connector 720 includes a first EAP material 722 that moves a paddle card 740 (e.g., the same as paddle card 240 illustrated in FIG. 2) into alignment with the contact housing 708 in the card connector housing 702 and a second EAP material 730 that moves the paddle card 740 such that the first plurality of contacts (e.g., the first plurality of contacts 246) connect with the card contacts in the contact housing 708. The card connector housing 702 also includes an electrical contact 706. The electrical contact 706 may be connected to the data processing card 102 and/or the card contacts in the contact housing 708 to receive power. As shown in FIG. 7B, when the cable connector housing 724 is inserted into the card connector housing 702, the first EAP material 722 contacts the electrical contact 706 of the card connector housing 702. If the electrical contact 706 is receiving power, the first EAP material 722 expands (indicated by reference numeral 722') in the direction of arrow C, illustrated in FIG. 7C. The expansion of the first EAP material 722' aligns the first plurality of contacts on the paddle card 740 with the card contacts in the contact housing 708. Expansion of the first EAP material 722' also moves the heatsink 726 to an extended position (indicated by reference numeral 726'). After the first EAP material 722' has expanded, the second EAP material 730 expands in the direction of arrow D, illustrated in FIG. 7D. For example, the cable connector housing 724 could include an electrical contact 732 that electrically couples the second EAP material 730 to the first EAP material 722 and/or to the electrical contact 706 after the first EAP material 722 is expanded. Expansion of the second EAP material 730 urges the paddle card 740 toward the contact housing 708 such that the first plurality of contacts of the paddle card 740 contact the respective card contacts in the card contact housing 708. The extended heatsink 726' will also shift in the direction of arrow D when the second EAP material 730 expands. Thus, the window (e.g., the window 106 illustrated in FIG. 1C) in the card connector housing 702 must be larger than the heatsink 726 to accommodate the shift of the heatsink 726 in the direction of arrow D after the heatsink 726' is extended.

Figure 8A:
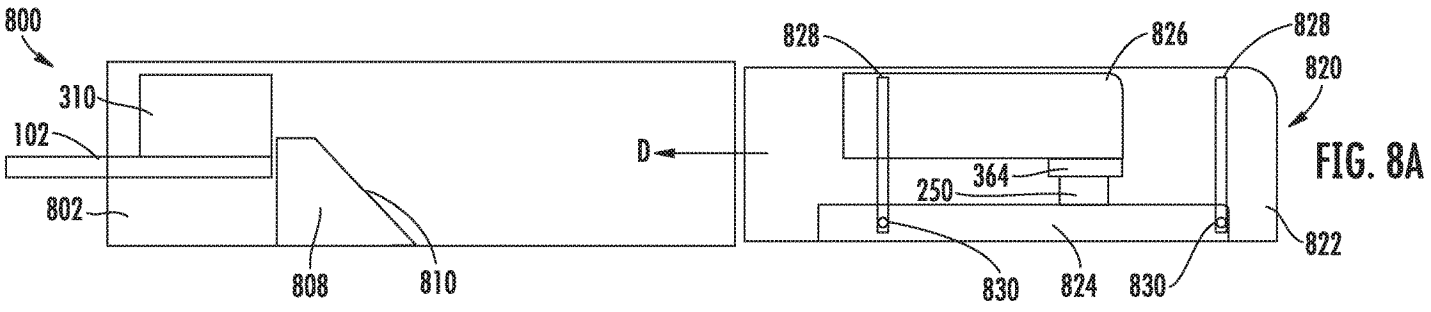
FIG. 8A is a cross-sectional side view of a cable connector housing and a card connector housing, according to one embodiment, in which the cable connector housing is aligned for insertion into the card connector housing.
Figure 8B:
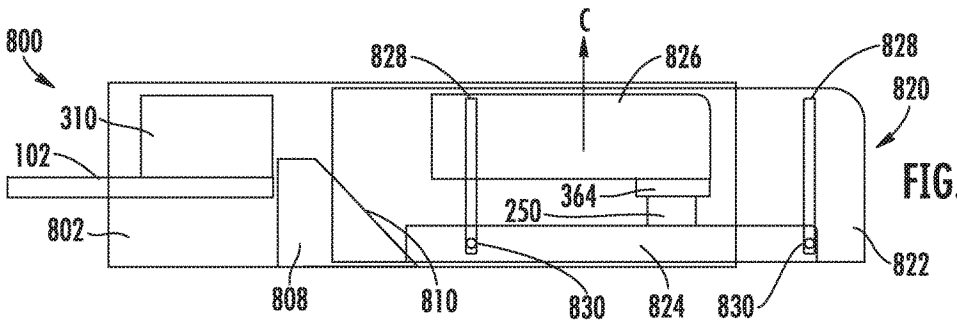
FIG. 8B is a cross-sectional side view of the cable connector housing and card connector housing of FIG. 8A in which the cable connector housing is partially inserted into the card connector housing.
Figure 8C:
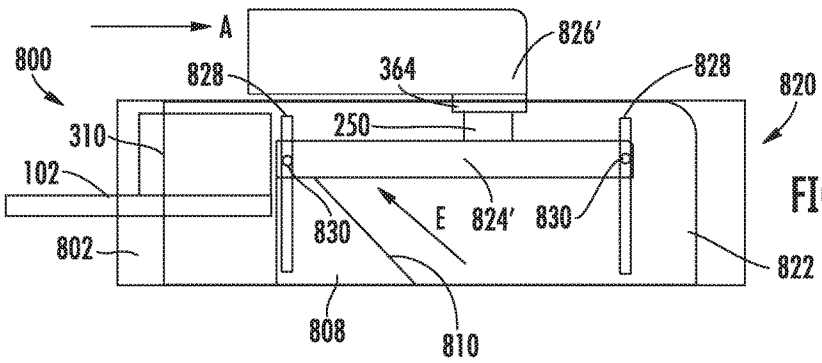
FIG. 8C is a cross-sectional side view of the cable connector housing and card connector housing of FIG. 8A in which the cable connector housing is further inserted into the card connector housing such that a paddle card is lifted by a ramp in the card connector housing.

FIGS. 8A-8C illustrate another embodiment of a card connector 800 and cable connector 820 in which a paddle card 824 (e.g., similar to or the same as the paddle card 240 illustrated in FIG. 2) shifts to make contact with the card contact housing 310. The paddle card 824 includes pins 830 that are arranged in slots or channels 828 in the cable connector housing 822 such that the paddle card 824, the semiconductor chip 250, in the heatsink 826 can move along the channels 828. As illustrated in FIGS. 8A and 8B, the heatsink 826 is in a retracted position when the pins 830 are arranged at one end of the channels 828. As illustrated in FIG. 8C, the heatsink 826 is in an extended position (indicated by reference numeral 826') when the pins 830 are arranged toward an opposing end of the channels 828. A card connector housing 802 of the card connector 800 includes a ramp 808 with an inclined surface 810 arranged facing the cable connector housing 822. The card contact housing 310 and the data processing card 102 are arranged proximate to an end of the inclined surface 810 of the ramp 808. As shown in FIG. 8B, when the cable connector housing 822 is inserted into the card connector housing 802, a first edge 842 of the paddle card 824 engages the inclined surface 810 of the ramp 808. As shown in FIG. 8C, as the cable connector housing 822 is inserted further into the card connector housing 802, the inclined surface 810 of the ramp 808 urges the paddle card 824 to move relative to the cable connector housing 822 along the channels 828. Stated differently, the paddle card 824 moves in the direction of arrow E shown in FIG. 8C as the cable connector housing 822 is further inserted into the card connector housing 802 and as the paddle card 824 moves along the channels 828. As the paddle card 824 moves along the channels 828, the heatsink 826 moves from the retracted position to the extended position. As the heatsink 826 moves from the retracted position to the extended position, the heatsink 826 also moves relative to the card connector housing 802. Thus, the window (e.g., the window 106 illustrated in FIG. 1C) in the card connector housing 802 must be larger than the heatsink 826 to accommodate the shift of the heatsink 826 after the heatsink 826' is extended.

In the embodiments described above, heatsinks can be optimally placed relative to semiconductor chips to provide sufficient cooling for the semiconductor chips. In addition, such heatsinks are extendable in a manner that does not require any specialized skills and/or tools to insert the cable connector housing into a card connector housing. For example, referring again to FIGS. 3A-3C, the illustrated heatsink 326 does not move to the extended position 326' until the heatsink 326 has moved past the opening 314 in the tailstock 312. Stated differently, an installer does not have to use any special techniques and/or tools to keep the heatsink 326 in the retracted position until the cable connector housing 324 is fully inserted in the card connector housing 304.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

While the foregoing is directed to embodiments of the present disclosure, other and further embodiments of the invention may be devised without departing from the basic scope thereof, and the scope thereof is determined by the claims that follow.

What is claimed is:

1. An electrical cable for engagement with a card connector, comprising:

a cable comprising multiple signal conductors;

a cable connector housing that includes a distal end, configured for engagement with a card connector housing of a card connector, and an opposing proximal end;

a paddle card arranged within the cable connector housing, the paddle card including:

a first plurality of contacts arranged along an edge of the paddle card facing the distal end of the cable connector housing, wherein the first plurality of contacts are configured to engage card connector contacts of the card connector;

a second plurality of contacts arranged along another edge of the paddle card toward the proximal end of the cable connector housing, wherein the second plurality of contacts are connected to respective ones of the multiple signal conductors;

a semiconductor chip arranged on the paddle card and in electrical communication with the first plurality of contacts and the second plurality of contacts, wherein the semiconductor chip is operable to modify electrical signals between the first and second plurality of contacts; and an electroactive polymer (EAP) material arranged on the paddle card, wherein the EAP material is electrically coupled to at least one of the first plurality of contacts;

a heat sink thermally coupled to the semiconductor chip, wherein:

the heat sink is movable from a retracted position to an extended position when the cable connector is seated in the card connector, the heat sink is positioned within the cable connector housing in the retracted position, at least a portion of the heat sink extends through the cable connector housing and the card connector housing in the extended position;

the heat sink is movable between the retracted position and the extended position about a hinge, the heat sink is pushed from the retracted position to the extended position;

the EAP material expands when the first plurality of contacts engage the card connector contacts and when the card connector contacts are receiving power, and expansion of the EAP material pushes the heat sink to the extended position.

2. The electrical cable of claim 1, wherein the hinge comprises a cylindrical shaft extending between opposing walls of the cable connector housing.

3. The electrical cable of claim 1, wherein the heat sink directly contacts the semiconductor chip.

4. The electrical cable of claim 1, further comprising a thermal interface disposed between the heat sink and the semiconductor chip.

5. The electrical cable of claim 4, wherein the thermal interface is a thermal paste.

6. An electrical cable for engaging a card connector, comprising:

a cable comprising multiple signal conductors;

a cable connector housing that includes a distal end, configured for engagement with a card connector housing of a card connector, and an opposing proximal end;

a paddle card arranged within the cable connector housing, wherein the paddle card is movable between a first position and a second position within the cable connector housing, the paddle card including:

a first plurality of contacts arranged along an edge of the paddle card facing the distal end of the cable connector housing, wherein the first plurality of contacts are configured to engage card connector contacts of the card connector;

a second plurality of contacts arranged along another edge of the paddle card toward the proximal end of the cable connector housing, wherein the second plurality of contacts are connected to respective ones of the multiple signal conductors; and a semiconductor chip arranged on the paddle card and in electrical communication with the first plurality of contacts and the second plurality of contacts, wherein the semiconductor chip is operable to modify electrical signals between the first and second plurality of contacts;

a heat sink thermally coupled to the semiconductor chip, wherein the heat sink is movable from a retracted position to an extended position when the cable connector is seated in the card connector, the heat sink is positioned within the cable connector housing in the retracted position, at least a portion of the heat sink extends through the cable connector housing and the card connector housing in the extended position, the heat sink is rigidly mounted to the semiconductor chip, the heat sink is in the retracted position when the paddle card is in the first position and is in the extended position when the paddle card is in the second position, the cable connector housing further comprises an electroactive polymer (EAP) material arranged on the cable connector housing between the cable connector housing and the paddle card on a side of the paddle card opposite the semiconductor chip and heat sink, the EAP material is configured to be electrically coupled to the card connector, and electrical power from the card connector causes the EAP material to expand, thereby causing the flexible paddle card to move from the first position to the second position and causing the heat sink to move from the retracted position to the extended position.

7. The electrical cable of claim 6, wherein the first plurality of contacts of the paddle card contact the card connector contacts when the paddle card moves to the second position.

8. The electrical cable of claim 6, further comprising a second EAP material that expands to push the paddle card toward the card connector contacts upon the flexible paddle card moving from the first position to the second position.

9. A system, comprising:

a computer card, comprising:

a data processing card; and a card connector housing that includes a first end and an opposing second end, wherein the card connector housing includes a window arranged at a location between the first and second ends, wherein the card connector housing includes a plurality of card contacts arranged toward the first end and an opening at a second opposing end, and wherein the plurality of card contacts are operatively connected to the data processing card;

a tailstock arranged at the second end of the card connector housing; and an electrical cable, comprising:

a cable comprising multiple signal conductors;

a cable connector housing that includes a distal end configured for engagement with the card connector housing and an opposing proximal end;

a paddle card arranged within the cable connector housing, the paddle card including:

a first plurality of contacts arranged along an edge of the paddle card facing the distal end of the cable connector housing, wherein the first plurality of contacts are configured to engage the plurality of card contacts of the card connector;

a second plurality of contacts arranged along another edge of the paddle card toward the proximal end of the cable connector housing, wherein the second plurality of contacts are connected to respective ones of the multiple signal conductors; and a semiconductor chip arranged on the paddle card and in electrical communication with the first plurality of contacts and the second plurality of contacts, wherein the semiconductor chip is operable to modify electrical signals between the first and second plurality of contacts;

a heat sink thermally coupled to the semiconductor chip, wherein the heat sink is movable from a retracted position to an extended position when the cable connector is seated in the card connector, wherein the heat sink is positioned within the cable connector housing in the retracted position, wherein at least a portion of the heat sink extends through the cable connector housing and the window in the card connector housing in the extended position, and wherein the heat sink moves to the extended position after the cable connector housing is inserted into the card connector housing and the heat sink has passed through the tailstock and is aligned with the window.

10. The system of claim 9, wherein the heat sink pivots into the extended position about a hinge.

11. The system of claim 9, wherein the heat sink is coupled to a hinge comprising a laminate, and the heat sink moves into the extended position due to differences in thermal expansion of different materials in the laminate.

12. The system of claim 9, wherein the heat sink is pushed from the retracted position to the extended position.

13. The system of claim 9, wherein a surface of the heat sink is configured to engage a ramp on the card connector housing when the first plurality of contacts engage the card connector contacts, and wherein engagement of the surface with the ramp pushes the heat sink to the extended position.

14. The system of claim 9, wherein the heat sink is coupled to the semiconductor chip via a curved bracket, the curved bracket comprising a laminate of a first metal layer and a second metal layer, wherein the first and second metal layers comprise different materials having different thermal expansion coefficients, wherein heat transfer from the semiconductor chip, during operation of the semiconductor chip, causes the curved bracket to move to a less-curved position, and wherein the heat sink is moved to the extended position when the bracket moves to the less-curved position.

15. The system of claim 9, wherein the paddle card comprises an electroactive polymer (EAP) material arranged thereon.

16. The system of claim 9, wherein the paddle card comprises an electroactive polymer (EAP) material arranged thereon, wherein the EAP material is electrically coupled to at least one of the first plurality of contacts, wherein the EAP material expands when the first plurality of contacts engage the card connector contacts and when the card connector contacts are receiving power, and wherein expansion of the EAP material pushes the heat sink to the extended position.

17. The system of claim 9, wherein the cable connector housing includes channels arranged at an angle relative to a planar surface of the paddle card on which the semiconductor chip is mounted, wherein the paddle card is translatable between a first position and a second position along the channels, wherein the card connector housing includes a ramp, wherein the paddle card is configured to engage the ramp in the card connector housing to move the paddle card from the first position to the second position, wherein the first plurality of contacts engage the card contacts when the paddle card moves to the second position, and wherein the heat sink translates with the paddle card to move to the extended position when the paddle card moves to the second position.

18. The system of claim 9, wherein the paddle card is flexible, wherein the heat sink is rigidly mounted to the semiconductor chip, wherein the cable connector housing further comprises an electroactive polymer (EAP) material arranged on the cable connector housing between the cable connector housing and the paddle card on a side of the paddle card opposite the semiconductor chip and heat sink, wherein the EAP material is configured to be electrically coupled to the card connector, and wherein electrical power from the card connector causes the EAP material to expand and to move the flexible paddle card and the heat sink to the extended position.

19. The system of claim 9, wherein the card connector housing includes channel defined by an angled surface, wherein the plurality of card contacts are positioned at an end of the channel, wherein the paddle card is movable between a first position and a second position about a hinge, wherein the paddle card is configured to engage the ramp in the card connector housing that moves the paddle card from the first position to the second position, wherein the first plurality of contacts engage the card contacts when the paddle card moves to the second position, and wherein the heat sink pivots with the paddle card and moves to the extended position through the window when the paddle card moves to the second position.

* * * * *